US006727220B1

(12) United States Patent
Grainger et al.

(10) Patent No.: US 6,727,220 B1
(45) Date of Patent: Apr. 27, 2004

(54) FABRIC SOFTENING COMPOSITIONS

(75) Inventors: David Stephen Grainger, Bebington (GB); Andrew Green, Bebington (GB); Mansur Sultan Mohammadi, Bebington (GB); Stephane Roth, Bebington (GB); Laurence Griffith Thompson, Bebington (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 136 days.

(21) Appl. No.: 09/569,924

(22) Filed: May 11, 2000

(30) Foreign Application Priority Data

May 17, 1999 (GB) ..... 9911437

(51) Int. Cl.[7] ..... C11D 3/37
(52) U.S. Cl. ..... 510/475; 510/516
(58) Field of Search ..... 510/475, 527, 510/516

(56) References Cited

U.S. PATENT DOCUMENTS

| | | | | |
|---|---|---|---|---|
| 4,386,213 A | | 5/1983 | Giesecke et al. | |
| 5,154,855 A | * | 10/1992 | Sekiguchi et al. | 252/312 |
| 5,419,842 A | | 5/1995 | Crutzen | |
| 5,447,643 A | | 9/1995 | Kelkenberg et al. | |
| 5,635,469 A | * | 6/1997 | Fowler et al. | 510/406 |
| 5,908,707 A | * | 6/1999 | Cabell et al. | 428/537.5 |
| 5,977,055 A | | 11/1999 | Trinh et al. | |
| 6,113,891 A | * | 9/2000 | Burdick et al. | 424/70.13 |
| 6,133,166 A | * | 10/2000 | Nissing et al. | 442/61 |
| 6,153,208 A | * | 11/2000 | McAtee et al. | 424/402 |

FOREIGN PATENT DOCUMENTS

| | | | |
|---|---|---|---|
| AU | 14416/88 | | 10/1988 |
| DE | 197 03 362 | | 11/1997 |
| DE | 197 32 073 | | 8/1998 |
| EP | 0 093 601 | A2 | 11/1983 |
| EP | 0 380 406 | B1 | 8/1990 |
| EP | 0 607 529 | B1 | 11/1993 |
| GB | 213 730 | | 4/1924 |
| WO | 95/00614 | | 1/1995 |
| WO | 96/15213 | | 5/1996 |
| WO | WO 96/37592 | * | 11/1996 |
| WO | WO 96/37594 | * | 11/1996 |
| WO | WO 96/37595 | * | 11/1996 |
| WO | 98/16538 | | 4/1998 |

OTHER PUBLICATIONS

International Search Report dated Aug. 25, 2000.

* cited by examiner

*Primary Examiner*—John Hardee
(74) *Attorney, Agent, or Firm*—Ellen Plotkin

(57) ABSTRACT

The invention provides a fabric softening composition comprising:

i) at least one nonionic fabric, and ii) at least one anionic surfactant, and iii) at least one cationic polymer wherein the particles formed from i), ii) and iii) have a net negative charge and the composition comprises no more than 1% by weight non-polymeric cationic surfactant and/or cationic fabric softening compounds. The compositions give good fabric softening without decreasing absorbency, and deposit well without being detrimentally affected by anionic carry-over from the wash. Also provided is a method of depositing a nonionic fabric softening agent from a fabric softening composition, comprising emulsifying the agent with an anionic surfactant and a cationic polymer or emulsifying the agent with an anionic surfactant and then post-dosing an aqueous solution of a cationic polymer to form a particle having an overall negative charge and treating fabric therewith.

12 Claims, No Drawings

FABRIC SOFTENING COMPOSITIONS

TECHNICAL FIELD

The present invention relates to fabric softening compositions, particularly to compositions that soften without adversely affecting the absorbency of the fabric and which deposit well onto the fabric without being detrimentally affected by anionic carry-over from the wash.

BACKGROUND AND PRIOR ART

Rinse added fabric softener compositions are well known. However, a disadvantage associated with conventional rinse conditioners is that although they increase the soft feel of a fabric they simultaneously decrease the fabric's absorbency. A decrease in the absorbency properties of a fabric means that its ability to take up water decreases. This is particularly disadvantageous with towels where the consumer requires the towel to be soft, and yet, have a high absorbency.

WO 98/16538 (Unilever) discloses fabric conditioning compositions comprising liquid or soft solid derivatives of a cyclic polyol or a reduced saccharide which give good softening but retain absorbency of the fabric.

EP 0 380 406 (Colgate-Palmolive) discloses detergent compositions comprising a saccharide or reduced saccharide ester containing at least one fatty acid chain.

WO 95/00614 (Kao Corporation) discloses softening compositions comprising polyhydric alcohol esters and cationised cellulose.

DE 19732073 (Henkel) discloses nitrogen free rinse conditioners containing water, anionic surfactants and fatty materials.

U.S. Pat. No. 5,447,643 (Hüls) discloses aqueous fabric softeners comprising nonionic surfactants and mono,di or tri fatty acid esters of certain polyols.

EP 607529 (Huels) discloses nonionic fabric softening agents stabilised by cationic colloids.

WO 96/15213 (Henkel) discloses textile softening agents containing alkyl, alkenyl and/or acyl group containing sugar derivatives, which are solid after esterification, in combination with nonionic and cationic emulsifiers.

A further problem associated with fabric softening agents that are not cationic in nature is that deposition onto a fabric is often inadequate which generally leads to softening results that are not as good as the consumer requires. In order to achieve deposition of such compositions a cationic surfactant deposition aid is typically used. However such deposition aids are usually adversely affected by anionic carry over from the wash and so high levels are needed to provide good results.

The present invention is directed towards alleviating the problems associated with the prior art as referred to hereinabove.

The principal advantages of the present invention include that excellent softening of the fabric is achieved without detriment to the absorbency of the fabric, the softening agent deposits well onto fabric and is not unduly adversely affected by anionic carryover from the wash. Furthermore the compositions are easily manufactured.

DEFINITION OF THE INVENTION

Thus according to one aspect of the invention there is provided a fabric softening composition comprising:

(i) at least one nonionic fabric softening agent and (ii) at least one anionic surfactant, and (iii) at least one cationic polymer wherein the particles formed from i), ii) and iii) have an overall net negative charge and the composition comprises no more than 1% by weight non-polymeric cationic surfactant and/or cationic fabric softening compounds.

It has been found, surprisingly, that these compositions provide an unexpected combination of simultaneous fabric softening and retention of absorbency and also deposit well onto the fabric without being detrimentally affected by anionic carry-over from the wash.

The invention also provides a method of depositing a nonionic fabric softening agent onto fabric from a fabric softening composition, comprising emulsifying the softening agent with an anionic surfactant and a cationic polymer to form a particle having an overall negative charge in the composition and treating said fabric with said composition.

The invention further provides a method of depositing a nonionic fabric softening agent onto fabric from a fabric softening composition comprising emulsifying the softening agent with an anionic surfactant and then post-dosing an aqueous solution of a cationic polymer to form a particle having an overall negative charge in the composition and treating said fabric with said composition.

In the compositions of the invention the particles formed from the fabric softening agent, the anionic surfactant and cationic polymer have an overall net negative charge. This is measured by Zeta potential measurements (e.g. as measured on a Malvern Instrument Zeta-Sizer).

It is particularly surprising that the particles deposit onto the fabric because of their overall net charge. Without wishing to be bound by theory it is believed that the above overall negatively charged particles have sufficient local positive charge associated with the polymer to allow them to deposit onto the surface of the fabric.

DETAILED DESCRIPTION OF THE INVENTION

Fabric Softening Agents

The compositions of the invention comprise at least one fabric softening agent chosen from nonionic fabric softeners.

The nonionic fabric softener may be any such suitable softener, but, particularly preferred nonionic softeners are the CPE and RSE compounds as defined herein.

In the context of the present invention the initials CPE or RSE stand for a liquid or soft solid derivative of a cyclic polyol or a reduced saccharide respectively which results from 35 to 100% of the hydroxyl groups of the cyclic polyol or reduced saccharide being esterified and/or etherified, the CPE or RSE having two or more ester or ether groups independently attached to a $C_8$ to $C_{22}$ alkyl or alkenyl chain.

The CPE or RSE used according to the invention does not have any substantial crystalline character at 20° C. Instead it is preferably in a liquid or soft solid state as herein defined at 20° C.

The liquid or soft solid (as hereinafter defined) CPEs or RSEs of the present invention result from 35 to 100% of the hydroxyl groups of the starting cyclic polyol or reduced saccharide being esterified or etherified with groups such that they are in the requisite liquid or soft solid state.

Typically the CPE's or RSE's have 3 or more ester or ether groups or mixtures thereof, for example 3 to 8, e.g. 3 to 5. Preferably the CPE or RSE has 4 or more ester or ether groups. It is preferred if two or more of the ester or ether groups of the CPE or RSE are independently of one another attached to a $C_8$ to $C_{22}$ alkyl or alkenyl chain. The $C_8$ to $C_{22}$ alkyl or alkenyl groups may be branched or linear carbon chains.

Preferably 35 to 85% of the hydroxyl groups of the cyclic polyol or reduced saccharide, most preferably 40 to 80%, even more preferably 45 to 75%, such as 45 to 70% are esterified or etherified.

Preferably the CPE or RSE contains 35% tri or higher esters, e.g. at least 40%.

CPEs are preferred for use with the present invention. Inositol is a preferred example of a cyclic polyol. Inositol derivatives are especially preferred.

In the context of the present invention the term cyclic polyol encompasses all forms of saccharides. Indeed saccharides are especially preferred for use with this invention. Examples of preferred saccharides from which the CPE's or RSE's may be derived are monosaccharides and disaccharides.

Examples of monosaccharides include xylose, arabinose, galactose, fructose, sorbose and glucose. Glucose is especially preferred. Examples of disaccharides include maltose, lactose, cellobiose and sucrose. Sucrose is especially preferred.

An example of a reduced saccharide is sorbitan.

The liquid or soft solid CPE's or RSE's of the present invention can be prepared by a variety of methods well known to those skilled in the art. These methods include acylation of the cyclic polyol or reduced saccharide with an acid chloride; trans-esterification of the cyclic polyol or reduced saccharide fatty acid esters using a variety of catalysts; acylation of the cyclic polyol or reduced saccharide with an acid anhydride and acylation of the cyclic polyol or reduced saccharide with a fatty acid. Typical preparations of these materials are disclosed in U.S. Pat. No. 4,386,213 and 14416/88 (Procter and Gamble).

If the CPE is a disaccharide it is preferred if the disaccharide has 3 or more ester or ether groups. Particularly preferred CPE's are esters with a degree of esterification of 3 to 5, for example, sucrose tri, tetra and penta esters.

Where the cyclic polyol is a reducing sugar it is advantageous if each ring of the CPE has one ether group, preferably at the $C_1$ position. Suitable examples of such compounds include methyl glucose derivatives.

Examples of suitable CPEs include esters of alkyl(poly) glucosides, in particular alkyl glucoside esters having a degree of polymerisation from 1 to 2.

The liquid or soft solid CPE's or RSE's of the present invention are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the NMR signal with a $T_2$ of less than 100 microsecond is considered to be a solid component and any component with $T_2$ is greater than 100 microseconds is considered to be a liquid component. For the CPE's and RSE's the tetra, penta etc prefixes only indicate the average degrees of esterification. The compounds exist as a mixture of materials ranging from the monoester to the fully esterified ester. It is the average degree of esterification which is used herein to define the CPE's and RSE's.

The HLB of the CPE or RSE is typically between 1 and 3.

Factors governing the suitability of the CPE's and RSE's are the presence and degree of branched chains, mixed chain lengths and the level of unsaturation.

It has been found that CPE's and RSE's having unsaturated or mixed alkyl chain lengths are particularly preferred.

The CPEs and RSEs for use in the invention include those recited in the following examples, including sucrose pentalaurate, sucrose tetraoleate, sucrose pentaerucate, sucrose tetraerucate, and sucrose pentaoleate. Suitable materials include some of the Ryoto series available from Mitsubishi Kagaku Foods Corporation.

Other nonionic fabric softening agents that may be used in the compositions include pentaerythritol esters, and sorbitan esters, mono, di and triglycerides, ester oils, mineral oils, fatty acids, fatty alcohols and alkyl polyglycosides.

The fatty acid may be a $C_8$–$C_{24}$ alkyl or alkenyl monerocarboxylic acid. Preferably the fatty acid is saturated. The fatty alcohols may have the same chain length as above.

Mixtures of any of the aforementioned types of nonionic fabric softening agents may be used.

The fabric softening agent is present in the composition preferably in total amount of 0.5%–80%, by weight based upon the total weight of the composition, more preferably 0.5%–50%, more preferably 1–30%, more preferably as 2–25%, e.g. 3–20%.

Anionic Surfactant

The anionic surfactant may be any suitable anionic surfactant conventionally used in laundry compositions.

The anionic surfactant may be chosen from soap and non-soap anionic surfactants and mixtures thereof.

Many suitable detergent active compounds are available and are fully described in the literature, for example, in "Surface-Active Agents and Detergents", Volumes I and II, by Schwartz, Perry and Berch.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions preferably comprise 0.1%–10% by weight anionic surfactant, more preferably 0.2%–5%, most preferably 0.5%–3.5%.

The weight ratio of fabric softening agent to anionic surfactant is preferably in the range 15:1 to 1:10, more preferably 10:1 to 1:5, most preferably 10:1 to 1:1.

Nonionic Emulsifier

The compositions may optionally further comprise nonionic emulsifiers. Any nonionic emulsifier conventionally used in laundry compositions may be used e.g. nonionic ethoxylated surfactants have an HLB of from about 10 to about 20. It is advantageous if the surfactant alkyl group contains at least 12 carbon atoms. If present the nonionic surfactant may be used in amounts of 0.1–10% by weight, preferably 0.2–5%.

Cationic polymers

The compositions further comprise cationic polymers. Any suitable cationic polymers may be used according to the invention. The cationic polymer is believed to act as a 'bridging' polymer and aids deposition of the emulsified fabric softener particle onto the surface of the fabric being treated.

Suitable cationic polymers include cationic quar polymers and their derivatives (e.g. the Jaguar series of polymers available from Rhodia), cationic cellulose polymers and their derivatives (e.g. the Celquat series of polymers available from National Starch and Chemical Ltd and the Ucare series of polymers available from Amerchol), cationic starches such as potato starch (e.g. the SoftGel and Solvitose series of polymers available from Avebe and the C*bond polymers series from Cerestar), and cationic chitosan and derivatives. Mixtures of such polymers may also be used.

Any of the cationic polymers recited in the following examples are suitable for use in the compositions of the invention.

The compositions preferably comprise 0.01–5% by weight of the cationic polymer, more preferably 0.05–4.5%, most preferably 0.1–3.5%, e.g. 0.1–3%.

The compositions comprise no more than 1% by weight in total of non-polymeric cationic surfactant and/or cationic fabric softening compounds. Preferably the compositions are substantially free of said cationic materials.

If a cationic surfactant or cationic softening compound, e.g. a quaternary ammonium compound, is present in the composition it is preferred that it is present in an amount of 0.75% by weight or less, preferably 0.5% or less such as 0.2% by weight or less.

In the compositions the weight ratio of the softening agent to the cationic polymer is preferably within the range 100:1 to 1:1, preferably 40:1 to 1:1, e.g. 10:1 to 1:1.

In the compositions the weight ratio of the softening agent to the total amount of anionic surfactant and cationic polymer is preferably within the range 15:1 to 1:10, more preferably 10:1 to 1:5, most preferably 10:1 to 1:1.

Other Polymers

Nonionic polymers may optionally be present in the compositions in addition to the cationic polymers. Suitable nonionic polymers that may optionally be present include the Pluronic series of polymers available from BASF, dialkyl PEGs, cellulose derivatives as described in GB 213 730 (Unilever), hydroxyethyl cellulose, starch, and hydrophobically modified nonionic polyols such as Acusol 880/882 available from Rohm & Haas.

Anionic polymers may also be present in the composition.

Optional ingredients

The compositions may also contain one or more optional ingredients, selected from oils, (such as vegetable oils and ester oils) electrolytes, non-aqueous solvents, pH buffering agents, perfumes, perfume carriers, fluorescers, colorants, hydrotropes, antifoaming agents, antiredeposition agents, polymeric and other thickeners, enzymes, optical brightening agents, opacifiers, anti-shrinking agents, anti-wrinkle agents, anti-spotting agents, germicides, fungicides, antioxidants, anti-corrosion agents, drape imparting agents, antistatic agents, sunscreens, colour care agents and ironing aids.

If the product is a liquid, a viscosity control agent may be included. Any viscosity control agent typically used with rinse conditioners is suitable, for example biological polymers such as Xanthum gum (Kelco ex Kelsan and Rhodopol ex Rhone-Poulenc). Synthetic polymers may also be used as viscosity control agents e.g. polyacrylic acid, poly vinyl pyrolidone, polyethylene, carbomers, polyethylene and polyethylene glycols.

It is preferred that the compositions are substantially free of bleaches. It is especially preferred that the compositions are entirely free of bleaches.

Product Form

The compositions may be in any form conventionally used for fabric softening compositions for example, powder, paste, gel or liquid. It is preferred if the product is a liquid and especially an emulsion. The compositions may be prepared by any suitable method. One method (method A) is to dissolve the cationic polymer in water, optionally with heating to assist dissolution, and then add the anionic surfactant. The solution initially becomes cloudy but clears when the polymer/surfactant complex re-dissolves. After this point the nonionic softener is added.

Another method (method B) is to emulsify the nonionic fabric softener with the anionic surfactant and then to post-dose an aqueous solution of the cationic polymer to this emulsion. A further method (method C) is to solubilise the polymer in solution and then add the anionic surfactant/nonionic softener as a co-melt.

EXAMPLES

The invention is illustrated by the following non-limiting examples. Further examples within the scope of the present invention will be obvious to the man skilled in the art.

Samples of the invention are denoted by a number and comparative samples are denoted by a letter.

Example 1

Compositions 1 to 24 in the table below were prepared by method A. All % are by weight as the active ingredient. Compositions A and B were prepared by dissolving the anionic surfactant in water, followed by adding the nonionic softer and mixing the composition for 10 minutes.

| Sample No. | Cationic Polymer Type and % by weight | Anionic surfactant type and % by weight | Fabric softener type and % by weight |
|---|---|---|---|
| 1 | A-0.05% | ABS-2% | ER290-4.5% |
| 2 | A-0.1% | ABS-2% | ER290-4.5% |
| 3 | B-0.1% | ABS-1% | ER290-4.5% |
| 4 | C-0.3% | ABS-1% | ER290-4.5% |
| 5 | C-0.4% | ABS-1% | ER290-4.5% |
| 6 | C-0.5% | ABS-1% | ER290-4.5% |
| 7 | C-0.7% | ABS-1% | ER290-4.5% |
| 8 | C-0.8% | ABS-1% | ER290-4.5% |
| 9 | C-0.9% | ABS-1% | ER290-4.5% |
| 10 | C-1.0% | ABS-1% | ER290-4.5% |
| 11 | C-1.5% | ABS-0.8% | ER290-4.5% |
| 12 | D-0.1% | ABS-1% | ER290-4.5% |
| 13 | D-0.2% | ABS-1% | ER290-4.5% |
| 14 | D-0.3% | ABS-1% | ER290-4.5% |
| 15 | E-0.1% | ABS-1% | ER290-4.5% |
| 16 | E-0.2% | ABS-1% | ER290-4.5% |
| 17 | E-0.3% | ABS-1% | ER290-4.5% |
| 18 | F-1.5% | SDS-0.75% | ER290-4.5% |
| 19 | F-2.0% | SDS-0.75% | ER290-4.5% |
| 20 | A-0.3% | ABS-3% | ER290-15% |
| 21 | C-3.0% | ABS-3% | ER290-15% |
| 22 | C-2.0% | G-0.50% | ER290-4.5% |
| 23 | C-1.5% | G-2.0% | ER290-2.5% |
| 24 | C-1.5% | G-3.5% | ER290-1.0% |
| A | — | G-2.0% | ER290-2.3% |
| B | — | G-3.0% | ER290-1.5% |

Polymer type A was Jaguar C13-S from Rhodia; a cationic guar gum.

Polymer type B was Jaguar C162 from Rhodia; a cationic guar gum.

Polymer type C was Softgel BDA from Avebe; a cationic potato starch.

Polymer type D was Ucare JR125 from Amerchol; a cationic cellulose.

Polymer type E was Ucare JR400 from Amerchol; a cationic cellulose.

Polymer type F was Solvitose from Avebe; a cationic starch.

ABS is sodium dodecyl benzene sulphonate from Aldrich.

SDS is sodium dodecyl sulphate from Aldrich.

G is sodium cocoyl isothionate from Akzo

ER290 is Ryoto ER290 (sucrose tetraerucate) available from Mitsubishi Kagaku Foods Corporation.

The compositions were all homogeneous in appearance. The particles formed from the cationic polymer, anionic surfactant and fabric softener had a net overall negative charge.

Example 2

Samples 6–10, 22, A and B and a commercial dilute fabric softening composition, C, were tested for fabric softening ability. To simulate the effects of carryover of anionic surfactant from the wash various amounts of 1% by weight solution of alkyl benzene sulphonate were added to the rinse liquor to determine how resistant the compositions are to such anionic carryover.

Softness Evaluation

Softening performance was evaluated by adding 0.1 g of fabric softening compound (2 ml of a 5% a.d. dispersion for liquids) to 1 liter of tap water, at ambient temperature in a tergotometer. Three pieces of terry towelling (8 cm×8 cm, 40 g total weight) were added to the tergotometer pot. The cloths were treated for 5 minutes at 65 rpm, spin dried to remove excess liquor and line dried overnight and conditioned at 21° C./65° C.

Softening of the fabric was assessed by an expert panel of 4 people using a round robin paired test protocol. Each panel member assessed four sets of test cloths. Each set contained one cloth of each sample under evaluation. Panel members were asked to assess softness on a nine point scale. In the table below a score of 1 represents a very soft fabric and 9 represents a very harsh fabric. Softness scores were calculated using an 'Analysis of Variance technique.

The softening results are given below.

| Sample | No of mls of 1% ABS added to replicate increasing levels of anionic carryover | | | | |
|---|---|---|---|---|---|
| No. | 0 | 1 | 2 | 3 | 4 |
| 6 | 4.75 | 4.25 | 3.75 | 3 | 4.25 |
| 7 | — | 3.0 | 2.75 | 2.5 | 2 |
| 8 | — | 2.5 | 2.75 | 2.75 | 3 |
| 9 | — | 3.0 | 3.5 | 2.75 | 3.5 |
| 10 | 3.75 | 4 | 3.75 | 3.75 | 4.0 |
| 22 | 3.9 | — | — | 4.6 | — |
| A | | | 5.9 | | |
| B | | | 6.8 | | |
| C[a] | | | 3.9 | | |

[a]dilute Comfort (commercially available June 1999)

The above results demonstrate that the compositions of the invention provide excellent softening results at various levels of simulated anionic carryover. The compositions also did not significantly decrease the absorbency of the treated fabric.

The results also show that, at 2 mls carryover, the compositions of the invention provided significantly better softening than the comparative composition which lacked a cationic polymer, and better softening than a commercially available dilute fabric softening composition

Example 3

A fully formulated fabric softening composition as according to the present invention was prepared as below:

| | % by weight |
|---|---|
| ABS | 1.0 |
| Sucrose ester oil | 4.5 |
| Softgel BDA | 1.0 |
| Dye | 0.0025 |
| Perfume | 0.3 |
| Minors | 0.02 |
| Water | balance |

The sucrose ester oil was Ryoto ER290 available from Mitsubishi Kagaku Foods Corporation. ABS and Softgel BDA are described above.

Example 4

A second fully formulated fabric softening composition was prepared as below:

| | % by weight |
|---|---|
| ABS | 0.4 |
| Sucrose ester oil | 15.4 |
| Softgel BDA | 2.0 |
| Dye | 0.0025 |
| Perfume | 0.96 |
| Nonionic emulsifier | 1.6 |
| Minors | 0.15 |
| Water | Balance |

The sucrose ester oil was Ryoto ER290, described above. The nonionic emulsifier was coco alcohol (15 EO).

The composition was prepared as follows:

An aqueous solution comprising 20 wt % of the nonionic emulsifier and the ABS (in a 4:1 weight ratio) was firstly mixed with 30.84 g of the sucrose ester oil and perfume under stirring, to form a water in oil emulsion.

Then 50 g of the Softgel BDA at 8 wt % was stirred into the emulsion followed by 98.36 g of cold demineralised water (also added under stirring). Finally the dye (o.5 g) and the minors were added and stirring was continued for a further 10 minutes.

The composition was monitored for 12 weeks, during which time it remained stable and homogenous.

Example 5

The table below shows the T2 NMR solid:liquid ratio of CPE's and RSE's used according to the present invention. The ratios were measured at 20° C. The degree of esterification/etherification is stated.

| Material | Solid:liquid ratio at 20° C. | Degree and % of esterification | | Physical form |
|---|---|---|---|---|
| Ryoto 0.170[1] | 0:100 | 5/8 | 62.5% | Liquid |
| Ryoto ER-290[2] | 0:100 | 4/8 | 50% | Liquid |
| Ryoto ER-190[3] | 0:100 | 5/8 | 50% | Soft solid |
| Ryoto POS-135[4] | 30:70 | 5/8 | 62.5% | Soft solid |
| Ryoto L-195[5] | 43:57 | 5/8 | 62.5% | Liquid |
| Sucrose tetraoleate | 0:100 | 4/8 | 50% | Liquid |

-continued

| Material | Solid:liquid ratio at 20° C. | Degree and % of esterification | | Physical form |
|---|---|---|---|---|
| Sucrose octaoleate | 0:100 | 8/8 | 100% | Liquid |

[1] = sucrose pentaolete
[2] = sucrose tetraerucate
[3] = sucrose pentaerucate
[4] = sucrose pentatallowate
[5] = sucrose pentalaurate

Example 6

Fabric Softening Compositions

The following example shows compositions according to the invention comprising various nonionic fabric softening agents.

The compositions were prepared by firstly adding the cationic polymer (hot) to water followed by adding the molten nonionic softener/anionic surfactant mixture thereto. The only exception to this was sample 1, where the subsequent order of addition was SLES followed by the sucrose monoester (coco/tallow chains).

In the samples where either Na soap or K soap is present (samples 2–5), this was achieved through in-situ neutralisation of HT fatty acid by either NaOH or KOH respectively. In these cases the NaOH or the KOH was added after the polymer and before the co-melted actives.

| Ingredient | sample 1 | sample 2 | sample 3 | sample 4 | sample 5 |
|---|---|---|---|---|---|
| Hardened tallow fatty acid[2] | 0 | 2.17% | 1.58% | 1.59% | 1.56% |
| Hardened tallow Na soap | 0 | 2.51% | 1.97% | 1.95% | 0 |
| Hardened tallow fatty alcohol[3] | 0 | 0 | 1.1% | 0 | 1.1% |
| Hardened tallow K soap | 0 | 0 | 0 | 0 | 2.09% |
| Sucrose monoester (coco/tallow chains)[1] | 4.5% | 0 | 0 | 1.1% | 0 |
| Na laureth ether sulphate (SLES)[4] | 0.5% | 0.5% | 0.5% | 0.5% | 0.5% |
| Cationic potato starch[5] | 1% | 1% | 1% | 1% | 1% |
| Water | to 100% | to 100% | to 100% | to 100% | To 100% |
| Softness score | 4.75 | 4.50 | 4.25 | 4.00 | 4.00 |

[1] = Sucrose monoester (coco/tallow chains) is available as Tegosoft PSE1419 (ex Goldschmidt AG)
[2] = Hardened tallow fatty acid is available as Pristerine 4916 (ex Unichema)
[3] = Hardened tallow fatty alcohol is available as Laurex CS (ex Albright & Wilson)
[4] = Na laureth ether sulphate (SLES) is available as Elfan NS2436 (ex Akzo-Nobel)
[5] = Cationic potato starch is available as Softgel BDA (ex Avebe)

Example 7

Measurement of Zeta Potential

The Zeta potential of the following example was measured on a Malvern Instrument Zeta Sizer.

0.75 wt % Softgel BDA (ex Avebe)

0.75 % wt % SDS (ex Adrich)

4.5 % wt % ER290 (ex Mitsubishi Kagaku)

Softgel BDA, SDS and ER290 are as described above.

The average zeta potential was minus 25.2 demonstrating that fabric softening particles formed from a nonionic fabric softener, an anionic surfactant and a cationic polymer have an overall net negative charge.

What is claimed is:

1. A fabric softening composition comprising:

(i) at least one nonionic fabric softening agent, and (ii) at least one anionic surfactant, and (iii) 0.05 to 4.5% by weight cationic polymer wherein particles formed from i), ii) and iii) have a net negative charge and the composition comprises no more than 1% by weight non-polymeric cationic surfactant and/or cationic fabric softening compounds.

2. A composition according to claim 1 wherein the nonionic fabric softener (i) comprises a liquid or soft solid derivative of a cyclic polyol (CPE) or of a reduced saccharide (RSE) resulting from 35 to 100% of the hydroxyl groups in the polyol or saccharide being esterified or etherified, the CPE or RSE having 2 or more ester or ether groups independently attached to a $C_8$–$C_{22}$ alkyl or alkenyl chain.

3. A composition according to claim 2 wherein the CPE or RSE contains at least 35% tri or higher esters.

4. A composition according to claim 1 wherein the cyclic polyol or reduced saccharide has 40–80% of the hydroxyl groups esterified and/or etherified.

5. A composition according to claim 1 wherein the CPE or RSE has 3 or more ester or ether groups.

6. A composition according to claim 1 wherein the CPE or RSE is derived from a monosaccharide or disaccharide.

7. A composition according to claim 1 comprising 0.5%–50% by weight of the fabric softening agent.

8. A composition according to claim 1 comprising 0.1%–10% by weight of the anionic surfactant.

9. A composition according to claim 1 wherein the cationic polymer is selected from cationic guar derivatives, cationic cellulose derivatives, cationic starch derivatives and, cationic chitosan derivatives or mixtures thereof.

10. A composition according to claim 1 comprising 0.01%–5% by weight of the cationic polymer.

11. A composition according to claim 1 wherein the weight ratio of softening agent to the total amount of anionic surfactant and cationic polymer is within the range 15:1 to 1:10.

12. A composition according to claim 1 which is a liquid.

* * * * *